US008995851B2

(12) United States Patent
Ikebata

(10) Patent No.: US 8,995,851 B2
(45) Date of Patent: Mar. 31, 2015

(54) DEVELOPING DEVICE HAVING AGITATION CONVEYANCE MEMBER WITH SCRAPER FOR WIPING TONER SENSOR AND IMAGE FORMING APPARATUS HAVING THE DEVELOPING DEVICE

(71) Applicant: KYOCERA Document Solutions Inc., Osaka (JP)

(72) Inventor: Yoshiaki Ikebata, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/197,104

(22) Filed: Mar. 4, 2014

(65) Prior Publication Data

US 2014/0270817 A1 Sep. 18, 2014

(30) Foreign Application Priority Data

Mar. 13, 2013 (JP) ..... 2013-049879

(51) Int. Cl.
*G03G 15/08* (2006.01)

(52) U.S. Cl.
CPC ..... *G03G 15/0824* (2013.01); *G03G 15/0862* (2013.01); *G03G 2215/0897* (2013.01); *G03G 15/0855* (2013.01); *G03G 15/0849* (2013.01)
USPC ..... 399/27

(58) Field of Classification Search
CPC ..... G03G 15/0827; G03G 15/0829; G03G 15/0853; G03G 15/0855; G03G 15/0889; G03G 15/0891; G03G 15/0893; G03G 2215/0897; G03G 15/0849; G03G 15/0824; G03G 15/0862
USPC ..... 399/62, 63, 64, 98, 256
See application file for complete search history.

(56) References Cited

U.S. PATENT DOCUMENTS

| | | | | |
|---|---|---|---|---|
| 4,901,115 | A * | 2/1990 | Nakamura et al. | 399/63 |
| 4,956,669 | A * | 9/1990 | Nakamura | 399/29 |
| 4,963,929 | A * | 10/1990 | Ueda et al. | 399/62 |
| 5,784,669 | A * | 7/1998 | Miura et al. | 399/58 |
| 6,438,330 | B1 * | 8/2002 | Itoh | 399/27 |
| 6,768,881 | B2 * | 7/2004 | Hatori | 399/63 |
| 7,558,496 | B2 * | 7/2009 | Watanabe | 399/62 |
| 8,145,100 | B2 * | 3/2012 | Hirayama et al. | 399/256 |
| 8,649,708 | B2 * | 2/2014 | Watanabe et al. | 399/256 |

FOREIGN PATENT DOCUMENTS

| | | | |
|---|---|---|---|
| JP | 2009122202 A | * | 6/2009 |
| JP | 2012168232 A | | 9/2012 |

* cited by examiner

*Primary Examiner* — Robert Beatty
(74) *Attorney, Agent, or Firm* — Alleman Hall McCoy Russell & Tuttle LLP

(57) ABSTRACT

A developing device includes a developer container, an agitation conveyance member, a toner detection sensor, and a scraper. Agitation conveyance member agitates and conveys a developer in developer container. Toner detection sensor detects a toner concentration or a remaining amount of toner in developer container. Scraper is provided in agitation conveyance member, and cleans a detection surface of toner detection sensor when agitation conveyance member rotates. Scraper includes a first member that comes into contact with detection surface of toner detection sensor when agitation conveyance member rotates forward, and a second member that comes into contact with detection surface of toner detection sensor when agitation conveyance member rotates reversely. First member has a wear resistance higher than that of second member, and a coefficient of friction between second member and detection surface is higher than a coefficient of friction between first member and detection surface.

8 Claims, 9 Drawing Sheets

DEVELOPING DEVICE HAVING AGITATION CONVEYANCE MEMBER WITH SCRAPER FOR WIPING TONER SENSOR AND IMAGE FORMING APPARATUS HAVING THE DEVELOPING DEVICE

INCORPORATION BY REFERENCE

This application is based upon and claims the benefit of priority from the corresponding Japanese Patent Application No. 2013-049879 filed on Mar. 13, 2013, the entire contents of which are incorporated herein by reference.

BACKGROUND

The present disclosure relates to a developing device and an image forming apparatus including the developing device. More particularly, the disclosure relates to: a developing device including a toner detection sensor that detects a toner concentration or a remaining amount of toner in a developer container, and a scraper that cleans a detection surface of the toner detection sensor; and an image forming apparatus including the developing device.

In an image forming apparatus, an electrostatic latent image formed on an image carrier composed of a photosensitive member and the like is developed by a developing device so as to be visible as a toner image. As an example of such a developing device, there is a developing device that adopts a two-component developing method using a two-component developer. This type of developing device includes a developer container that contains a two-component developer composed of carrier and toner, a developing roller that supplies the developer to the image carrier, and an agitation conveyance member that conveys the developer in the developer container while agitating the developer, and supplies the developer to the developing roller.

In the developing device, the toner is consumed by the developing operation. Therefore, in order to replenish the toner by an amount consumed by the development, it is necessary to measure the toner concentration in the developer by a toner concentration detection sensor (toner detection sensor) provided in the developer container.

In order to accurately measure the toner concentration, it is necessary to suppress accumulation of the developer on a detection surface of the toner concentration detection sensor. Therefore, the agitation conveyance member is provided with a scraper for cleaning the detection surface of the toner concentration detection sensor. When the agitation conveyance member rotates, the scraper slides on the detection surface of the toner concentration detection sensor to clean the detection surface. When a nonwoven fabric is used as the scraper, the detection surface of the toner concentration detection sensor can be effectively cleaned.

It is noted that a developing device using a nonwoven fabric as a scraper for cleaning a detection surface of a toner concentration detection sensor has been known.

SUMMARY

A developing device according to an aspect of the present disclosure includes a developer container, an agitation conveyance member, a toner detection sensor, and a scraper. The developer container contains a developer including toner. The agitation conveyance member agitates and conveys the developer in the developer container. The toner detection sensor detects a toner concentration or a remaining amount of toner in the developer container. The scraper is provided in the agitation conveyance member, and cleans a detection surface of the toner detection sensor when the agitation conveyance member rotates. The agitation conveyance member is configured to be rotatable forward and reversely. The scraper includes a first member that comes into contact with the detection surface of the toner detection sensor when the agitation conveyance member rotates forward, and a second member that comes into contact with the detection surface of the toner detection sensor when the agitation conveyance member rotates reversely. The first member has a wear resistance higher than that of the second member, and a coefficient of friction between the second member and the detection surface is higher than a coefficient of friction between the first member and the detection surface.

An image forming apparatus according to another aspect of the present disclosure includes a developing device. The developing device includes a developer container, an agitation conveyance member, a toner detection sensor, and a scraper. The developer container contains a developer including toner. The agitation conveyance member agitates and conveys the developer in the developer container. The toner detection sensor detects a toner concentration or a remaining amount of toner in the developer container. The scraper is provided in the agitation conveyance member, and cleans a detection surface of the toner detection sensor when the agitation conveyance member rotates. The agitation conveyance member is configured to be rotatable forward and reversely. The scraper includes a first member that comes into contact with the detection surface of the toner detection sensor when the agitation conveyance member rotates forward, and a second member that comes into contact with the detection surface of the toner detection sensor when the agitation conveyance member rotates reversely. The first member has a wear resistance higher than that of the second member, and a coefficient of friction between the second member and the detection surface is higher than a coefficient of friction between the first member and the detection surface.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
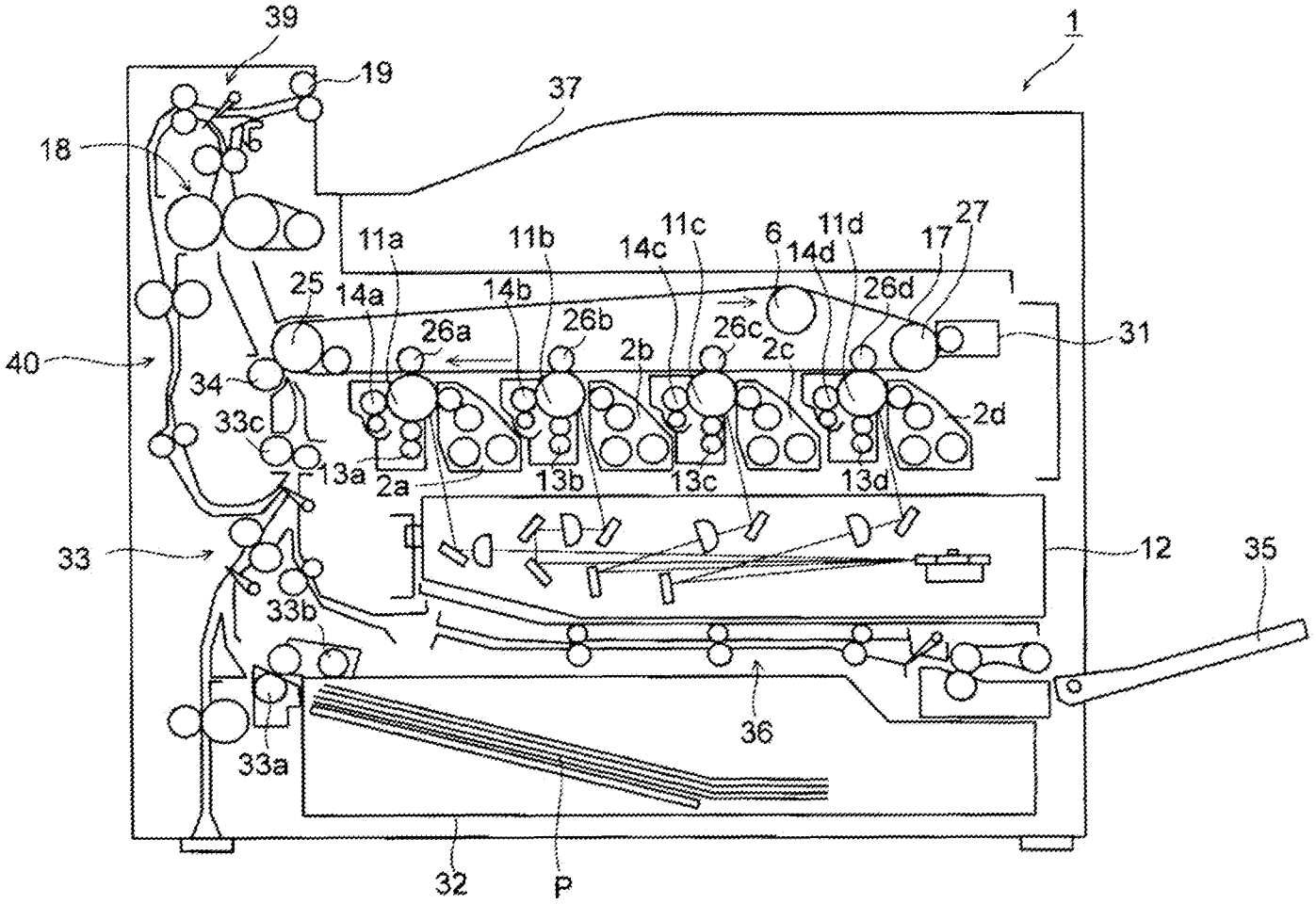
FIG. 1 is a cross-sectional view showing an entire configuration of an image forming apparatus including a developing device according to an embodiment of the present disclosure.

Hereinafter, an embodiment of the present disclosure will be described with reference to the drawings.

With reference to FIGS. 1 to 9, a structure of an image forming apparatus 1 according to the embodiment of the present disclosure will be described. The image forming apparatus 1 of the present embodiment is a tandem-type color printer. As rotatable photosensitive drums (image carriers) 11*a* to 11*d*, for example, organic photoconductors (OPC) including organic photosensitive layers or amorphous silicon photosensitive members including amorphous silicon photosensitive layers are used. The photosensitive drums 11*a* to 11*d* are disposed corresponding to colors of magenta, cyan, yellow, and black, respectively. Developing devices 2*a* to 2*d*, an exposure unit 12, charging devices 13*a* to 13*d*, and cleaning devices 14*a* to 14*d* are disposed around the photosensitive drums 11*a* to 11*d*, respectively.

The developing devices 2*a* to 2*d* are disposed to the right of the photosensitive drums 11*a* to 11*d* so as to oppose the photosensitive drums 11*a* to 11*d*, and supply toner to the photosensitive drums 11*a* to 11*d*, respectively. The charging devices 13*a* to 13*d* are disposed upstream of the developing devices 2*a* to 2*d* in a photosensitive drum rotation direction so as to oppose the surfaces of the photosensitive drums 11*a* to 11*d*, and uniformly charge the surfaces of the photosensitive drums 11*a* to 11*d*, respectively.

The exposure unit 12 scans and exposes the photosensitive drums 11*a* to 11*d*, based on image data, such as characters and pictures, input to an image input portion (not shown) via a personal computer or the like. The exposure unit 12 is disposed beneath the developing devices 2*a* to 2*d*. The exposure unit 12 includes a laser light source and a polygon mirror, and further includes reflection mirrors and lenses corresponding to the respective photosensitive drums 11*a* to 11*d*. Laser light emitted from the laser light source is applied, through the polygon mirror, the reflection mirrors, and the lenses, to the surfaces of the photosensitive drums 11*a* to 11*d* from the downstream side of the charging devices 13*a* to 13*d* in the photosensitive drum rotation direction. The applied laser light forms an electrostatic latent image on each of the surfaces of the photosensitive drums 11*a* to 11*d*. The electrostatic latent image is developed into a toner image by each of the developing devices 2*a* to 2*d*.

An intermediate transfer belt 17 that is an endless belt is extended on and between a tension roller 6, a driving roller 25, and a follower roller 27. The driving roller 25 is driven to rotate by a motor (not shown), and the intermediate transfer belt 17 is driven to circulate by rotation of the driving roller 25.

The photosensitive drums 11*a* to 11*d* are arranged under the intermediate transfer belt 17, side by side along a conveyance direction (a direction indicated by an arrow in FIG. 1) such that they are in contact with the intermediate transfer belt 17. Primary transfer rollers 26*a* to 26*d* oppose the photosensitive drums 11*a* to 11*d* across the intermediate transfer belt 17, respectively, and are pressed against the intermediate transfer belt 17 to form a primary transfer portion. In the primary transfer portion, the toner images of the photosensitive drums 11*a* to 11*d* are sequentially transferred to the intermediate transfer belt 17 at predetermined timings, according to rotation of the intermediate transfer belt 17. Thus, on the surface of the intermediate transfer belt 17, a full color toner image is formed in which the toner images of the four colors, i.e., magenta, cyan, yellow, and black, are superimposed.

A secondary transfer roller 34 opposes the driving roller 25 across the intermediate transfer belt 17, and is pressed against the intermediate transfer belt 17 to form a secondary transfer portion. In the secondary transfer portion, the toner image on the surface of the intermediate transfer belt 17 is transferred to a paper sheet P. After the transfer, a belt cleaning device 31 removes residual toner on the intermediate transfer belt 17 to clean the intermediate transfer belt 17.

In the lower portion of the image forming apparatus 1, a sheet feed cassette 32 in which paper sheets P are stored is disposed. A stack tray 35 for manual sheet feeding is disposed to the right of the sheet feed cassette 32. A first paper sheet conveyance path 33 through which a paper sheet P fed from the sheet feed cassette 32 is conveyed to the secondary transfer portion of the intermediate transfer belt 17, is disposed to the left of the sheet feed cassette 32. A second paper sheet conveyance path 36 through which a paper sheet fed from the stack tray 35 is conveyed to the secondary transfer portion, is disposed to the left of the stack tray 35. Further, a fixing portion 18 that performs a fixing process for a paper sheet P on which an image is formed, and a third paper sheet conveyance path 39 through which the paper sheet on which the fixing process has been performed is conveyed to a paper sheet discharge portion 37, are disposed in the upper left portion of the image forming apparatus 1.

The sheet feed cassette 32 can be replenished with paper sheets when being pulled out from the main body of the image forming apparatus 1 (the near side in FIG. 1). The stored paper sheets P are one by one fed to the first paper sheet conveyance path 33 side by a pickup roller 33*b* and a sheet feed roller pair 33*a*.

The first paper sheet conveyance path 33 and the second paper sheet conveyance path 36 join together at a position before a registration roller pair 33*c*, and the paper sheet P is conveyed to the secondary transfer portion such that a timing of the image forming operation at the intermediate transfer belt 17 and a timing of the sheet feeding operation are adjusted by the registration roller pair 33*c*. Onto the paper sheet P conveyed to the secondary transfer portion, the full color toner image on the intermediate transfer belt 17 is secondarily transferred by the secondary transfer roller 34 to which a bias voltage is applied, and then the paper sheet P is conveyed to the fixing portion 18.

The fixing portion 18 includes a fixing belt heated by a heater, a fixing roller inscribed to the fixing belt, a pressure roller disposed so as to be pressed against the fixing roller across the fixing belt, and the like, and performs a fixing process by heating and pressurizing the paper sheet P on which the toner image is transferred. After the toner image is fixed on the paper sheet P by the fixing portion 18, the paper sheet P is, according to need, reversed in a fourth paper sheet conveyance path 40 and then a toner image is secondarily transferred also onto the other side of the paper sheet P by the secondary transfer roller 34 and fixed by the fixing portion 18. The paper sheet P having the toner image fixed thereon is discharged through a third paper sheet conveyance path 39 to the paper sheet discharge portion 37 by a discharge roller pair 19.

Figure 2:
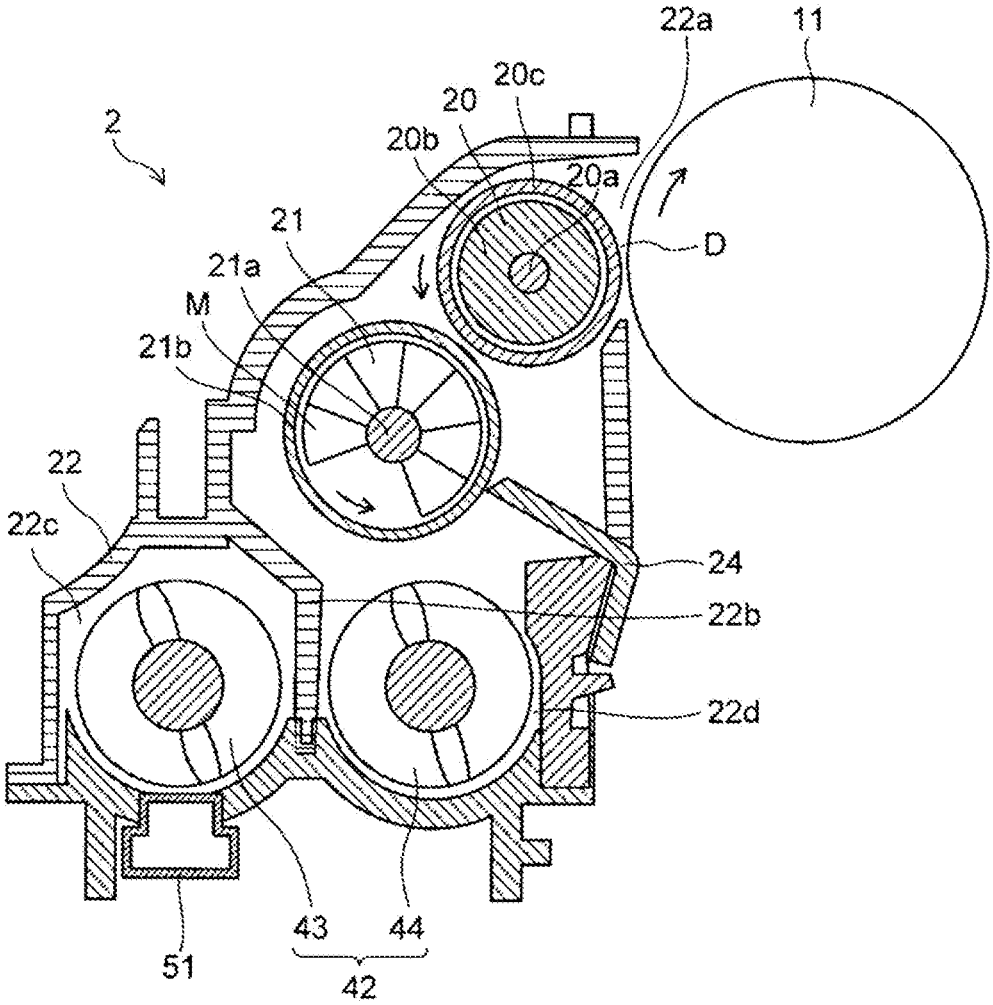
FIG. 2 is a sectional side view showing a structure of the developing device according to the embodiment of the present disclosure.

Next, the structure of the developing device 2*a* will be described in detail with reference to FIG. 2. FIG. 2 shows the developing device 2*a* viewed from the back side of FIG. 1, and right and left of each of the components in the developing device 2*a* are reversed from those shown in FIG. 1. Hereinafter, the configuration and operation of the developing device 2*a* corresponding to the photosensitive drum 11*a* shown in FIG. 1 will be described. Since the configurations and operations of the developing devices 2*b* to 2*d* are identical to those of the developing device 2*a*, description thereof will be omitted. In addition, symbols "a" to "d" indicating the developing devices and the photosensitive drums corresponding to the respective colors will be omitted.

As shown in FIG. 2, the developing device 2 includes a developing roller (developer carrier) 20, a magnetic roller 21, a regulation blade 24, an agitation conveyance member 42, a developer container 22, and the like.

The developer container 22 forms an outer frame of the developing device 2, and a partition portion 22*b* thereof partitions a lower space in the developer container 22 into a first conveyance chamber 22*c* and a second conveyance chamber 22*d*. A two-component developer composed of carrier and toner is contained in the first conveyance chamber 22*c* and the second conveyance chamber 22*d*. The agitation conveyance member 42, the magnetic roller 21, and the developing roller 20 are rotatably supported by the developer container 22. Further, the developer container 22 has an opening 22*a* that exposes the developing roller 20 toward the photosensitive drum 11.

The developing roller 20 is disposed to the left of the photosensitive drum 11 so as to oppose the photosensitive drum 11 at a predetermined gap. A development region D in which the developing roller 20 supplies the toner to the photosensitive drum 11 is provided at a position where the developing roller 20 and the photosensitive drum 11 are closest to each other. The magnetic roller 21 is disposed diagonally left-downward of the developing roller 20 so as to oppose the developing roller 20 at a predetermined gap. The magnetic roller 21 supplies the toner to the developing roller 20 at a position where the magnetic roller 21 and the developing roller 20 closely oppose each other. The agitation conveyance member 42 is disposed substantially beneath the magnetic roller 21. The regulation blade 24 is fixed to and held by the developer container 22 at a position diagonally right-downward of the magnetic roller 21.

The agitation conveyance member 42 is composed of two helical members, i.e., a first helical member 43 and a second helical member 44. The second helical member 44 is disposed under the magnetic roller 21 and inside the second conveyance chamber 22*d*. The first helical member 43 is disposed to the left of the second helical member 44 and inside the first conveyance chamber 22*c*.

The first and second helical members 43 and 44 agitate the developer to charge the toner in the developer at a predetermined level. Thereby, the toner is held by the carrier. Communication portions (an upstream-side communication portion 22*e* and a downstream-side communication portion 22*f* described later) are provided at both ends in a longitudinal direction (a direction perpendicular to the surface of the sheet of FIG. 2) of the partition portion 22*b* that separates the first conveyance chamber 22*c* from the second conveyance chamber 22*d*. When the first helical member 43 rotates, the charged developer is conveyed from one of the communication portions provided in the partition portion 22*b* to the second helical member 44, and the developer circulates in the first conveyance chamber 22*c* and the second conveyance chamber 22*d*. Then, the developer is supplied from the second helical member 44 to the magnetic roller 21.

The magnetic roller 21 includes a roller shaft 21*a*, a magnetic pole member M, and a nonmagnetic sleeve 21*b* formed of a nonmagnetic material. The magnetic roller 21 carries the developer supplied from the agitation conveyance member 42, and supplies, to the developing roller 20, only the toner out of the carried developer. The magnetic pole member M is composed of a plurality of cross-sectionally fan-shaped magnets having different polarities at the outer circumferential portions thereof. The magnetic pole member M is fixed to the roller shaft 21*a* by adhesion, for example. The roller shaft 21*a* is, inside the nonmagnetic sleeve 21*b*, unrotatably supported by the developer container 22 such that a predetermined space is provided between the magnetic pole member M and the nonmagnetic sleeve 21*b*. The nonmagnetic sleeve 21*b* is rotated by a drive mechanism (not shown) including a motor and a gear, in the same direction as the developing roller 20 (the counterclockwise direction in FIG. 2), and a bias voltage resulting from superposing an AC voltage on a DC voltage is applied to the nonmagnetic sleeve 21*b*. On the surface of the nonmagnetic sleeve 21*b*, the charged developer is carried, in a form of a magnetic brush, by the magnetic force of the magnetic pole member M, and the magnetic brush is adjusted to a predetermined height by the regulation blade 24.

When the nonmagnetic sleeve 21*b* rotates, the magnetic brush is conveyed while being carried on the surface of the nonmagnetic sleeve 21*b* by the magnetic pole member M. When the magnetic brush comes into contact with the developing roller 20, only the toner in the magnetic brush is supplied to the developing roller 20 in accordance with the bias voltage applied to the nonmagnetic sleeve 21*b*.

The developing roller 20 includes a stationary shaft 20*a*, a magnetic pole member 20*b*, a developing sleeve 20*c* that is formed of a nonmagnetic metal material in a cylindrical shape, and the like.

The stationary shaft 20*a* is unrotatably supported in the developer container 22. The developing sleeve 20*c* is rotatably held by the stationary shaft 20*a*. Further, the magnetic pole member 20*b* formed of a magnet is fixed to the stationary shaft 20*a* by adhesion or the like such that the magnetic pole member 20*b* opposes the magnetic roller 21 with a predetermined space provided between the developing sleeve 20*c* and the magnetic pole member 20*b*. The developing sleeve 20*c* is rotated by a drive mechanism (not shown) including a motor and a gear in a direction (counterclockwise direction) indicated by an arrow in FIG. 2. Further, a development bias voltage resulting from superposing an AC voltage on a DC voltage is applied to the developing sleeve 20*c*.

When the developing sleeve 20*c* to which the development bias voltage is applied rotates in the counterclockwise direction in FIG. 2, then, in the development region D, the toner carried on the surface of the developing sleeve 20*c* flies toward the photosensitive drum 11 due to a difference between the potential of the development bias voltage and the potentials of the exposed portions of the photosensitive drum 11. The flying toner successively attaches to the exposed portions on the photosensitive drum 11 rotating in a direction (clockwise direction) indicated by an arrow in FIG. 2, and thereby the electrostatic latent image on the photosensitive drum 11 is developed.

Next, the agitation portion of the developing device will be described in detail.

Figure 3:
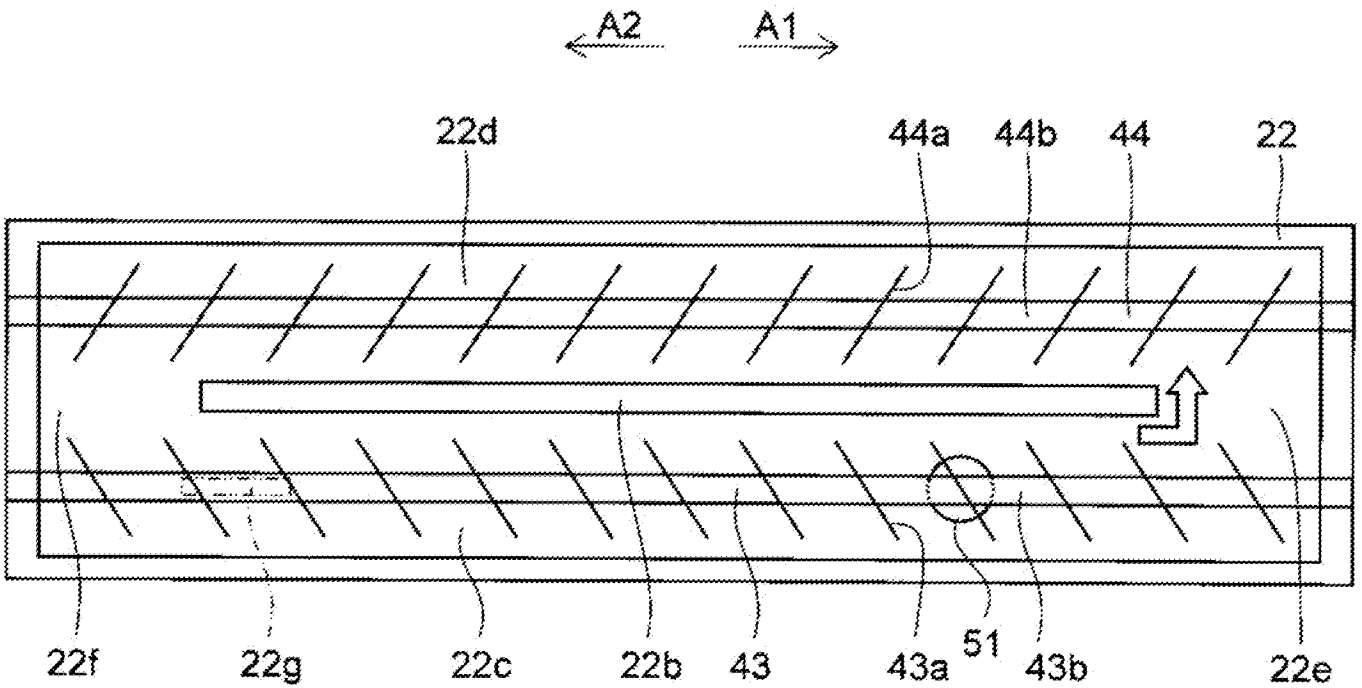
FIG. 3 is a sectional plan view showing a structure of an agitation portion of the developing device according to the embodiment of the present disclosure.

In the developer container 22, as shown in FIG. 3, the partition portion 22*b*, the first conveyance chamber 22*c*, the second conveyance chamber 22*d*, the upstream-side communication portion 22*e*, and the downstream-side communication portion 22*f* are provided as described above, and in addition, a developer replenishment port 22*g* is provided. The developer replenishment port 22*g* is an opening for replenishing the developer container 22 with new toner and carrier from a developer replenishment container (not shown) disposed above the developer container 22. The developer replenishment port 22*g* is provided at an upper portion on the upstream side of the first conveyance chamber 22*c* (the left side in FIG. 3). In the first conveyance chamber 22*c*, the left side in FIG. 3 is the upstream side, and the right side in FIG. 3 is the downstream side. Further, in the second conveyance chamber 22*d*, the right side in FIG. 3 is the upstream side and the left side in FIG. 3 is the downstream side. Accordingly, the communication portions are referred to as "upstream-side communication portion" and "downstream-side communication portion" with reference to the second transport chamber 22.

The partition portion 22*b* extends in the longitudinal direction of the developer container 22 and partitions the developer container 22 into the first conveyance chamber 22*c* and the second conveyance chamber 22*d* so as to be parallel to each other. The upstream-side communication portion 22*e* and the downstream-side communication portion 22*f* are provided at one end and the other end of the partition portion 22*b* in the longitudinal direction thereof (an end in direction A1 and an end in direction A2), respectively. The upstream-side communication portion 22*e* connect the end portions, in the direction A1, of the first conveyance chamber 22*c* and the second conveyance chamber 22*d* to each other. The downstream-side communication portion 22*f* connects the end portions, in the direction A2, of the first conveyance chamber 22*c* and the second conveyance chamber 22*d* to each other. Thereby, the developer is allowed to circulate in the first conveyance chamber 22*c*, the upstream-side communication portion 22*e*, the second conveyance chamber 22*d*, and the downstream-side communication portion 22*f*.

The first helical member 43 has a rotation shaft 43*b*, and a first helical blade (blade) 43*a* formed integrally with the rotation shaft 43*b*. The first helical blade 43*a* has a helical shape winding around the rotation shaft 43*b* in its axial direction at a constant pitch. The rotation shaft 43*b* is rotatably supported by the developer container 22. The first helical blade 43*a* conveys the developer in the first conveyance chamber 22*c* in the direction A1 while agitating the developer.

Figure 4:
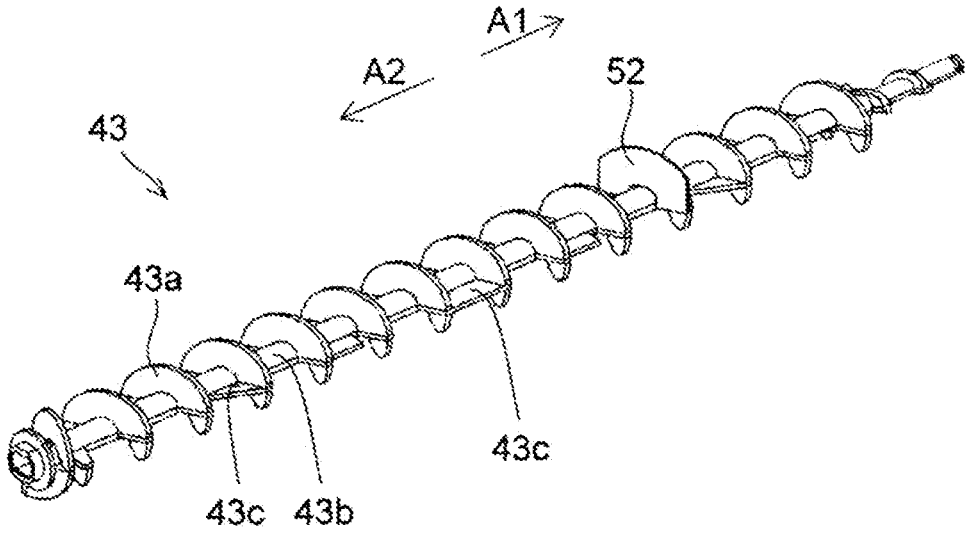
FIG. 4 is a perspective view showing a structure of a first helical member of the developing device according to the embodiment of the present disclosure.
Figure 5:
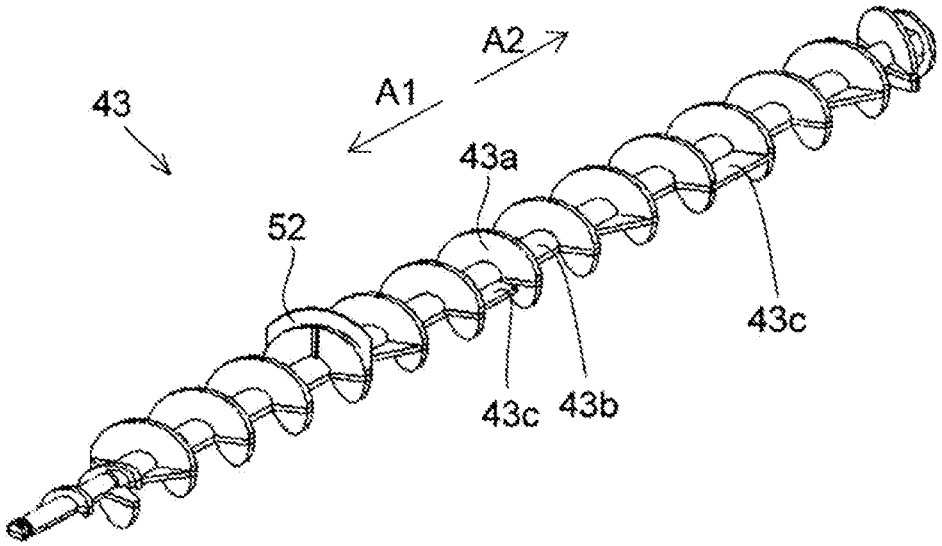
FIG. 5 is a perspective view showing the structure of the first helical member of the developing device according to the embodiment of the present disclosure.

Further, as shown in FIGS. 4 and 5, the first helical member 43 has a plurality of ribs 43*c* that are formed integrally with the first helical blade 43*a* and the rotation shaft 43*b*. The ribs 43*c* control the developer conveyance speed. It is noted that the first helical member 43 is driven to rotate by a motor (not shown), and is configured to be rotatable in a forward direction for a printing operation (when image formation is performed) and in a reverse direction for a cleaning operation (when image formation is not performed) by means of a nonwoven fabric 52*a* described later.

As shown in FIG. 3, the second helical member 44 has a rotation shaft 44*b*, and a second helical blade 44*a* formed integrally with the rotation shaft 44*b*. The second helical blade 44*a* has a helical shape winding around the rotation shaft 44*b* in its axial direction at the same pitch as the first helical blade 43*a*. The second helical blade 44*a* is a blade facing in a direction opposite to the direction of (being in a phase opposite to the phase of) the first helical blade 43*a*. The rotation shaft 44*b* is disposed in parallel with the rotation shaft 43*b*, and is rotatably supported by the developer container 22. The second helical blade 44*a* conveys the developer in the second conveyance chamber 22*d* in the direction A2 (a direction opposite to the direction A1) while agitating the developer to supply the developer to the developing roller 20.

The first helical member 43 is formed of resin such as PS (polystyrene), ABS (acrylonitrile butadiene styrene copolymer), or PC (polycarbonate), and the first helical blade 43*a* and the rotation shaft 43*b* are integrally molded. Likewise, the second helical member 44 is also formed of resin such as PS, ABS, or PC, and the second helical blade 44*a* and the rotation shaft 44*b* are integrally molded. The rotation shafts 43*b* and 44*b* are formed of resin only, and have no metal rods as shaft cores.

Figure 6:
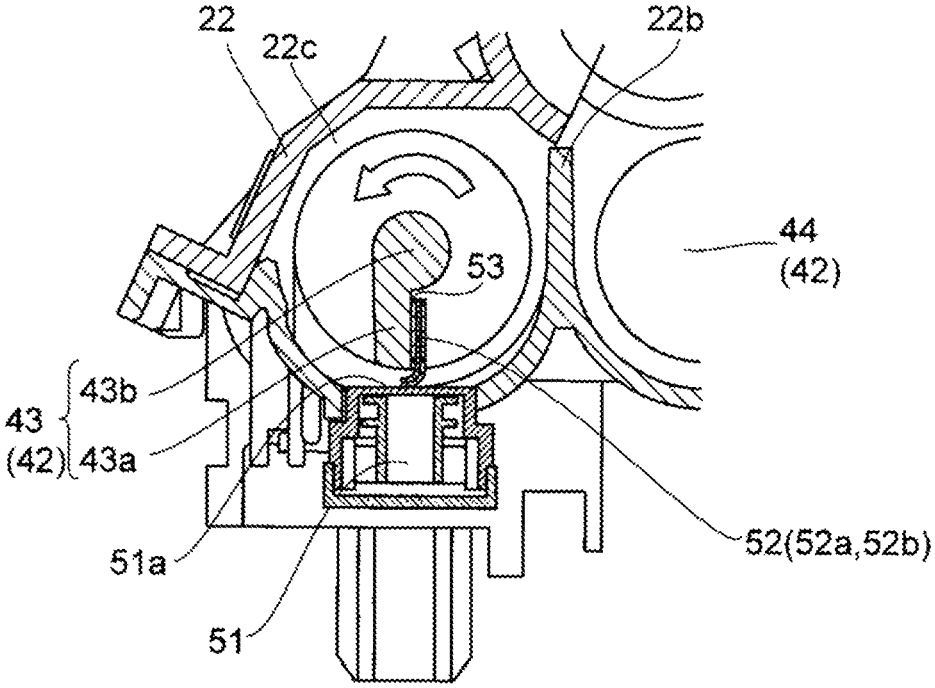
FIG. 6 is a sectional side view showing a structure in the vicinity of the first helical member of the developing device according to the embodiment of the present disclosure.

As shown in FIGS. 3 and 6, in the first conveyance chamber 22*c*, a toner concentration detection sensor (toner detection sensor) 51 is disposed near the upstream side of the upstream-side communication portion 22*e* in a developer conveyance direction (a direction indicated by an white arrow in FIG. 3).

As an example of the toner concentration detection sensor 51, a magnetic permeability sensor is used which detects a magnetic permeability of a developer in the developer container 22. When the magnetic permeability of the developer is detected by the toner concentration detection sensor 51, a voltage value corresponding to the detection result is output to a control portion (not shown). The control portion determines the toner concentration based on the output value from the toner concentration detection sensor 51.

The output value from the sensor 51 varies according to the toner concentration. The higher the toner concentration, the higher the ratio of the toner to the magnetic carrier. Such an increase in the ratio of the toner that is not magnetically conductive results in a reduction in the output value. On the other hand, the lower the toner concentration, the lower the ratio of the toner to the carrier. Such an increase in the ratio of the carrier that is magnetically conductive results in an increase in the output value.

Figure 7:
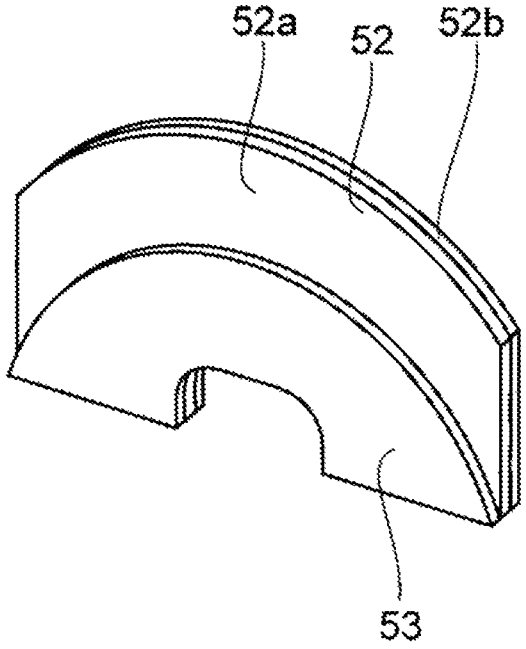
FIG. 7 is an enlarged perspective view showing a structure of a scraper of the developing device according to the embodiment of the present disclosure.
Figure 8:
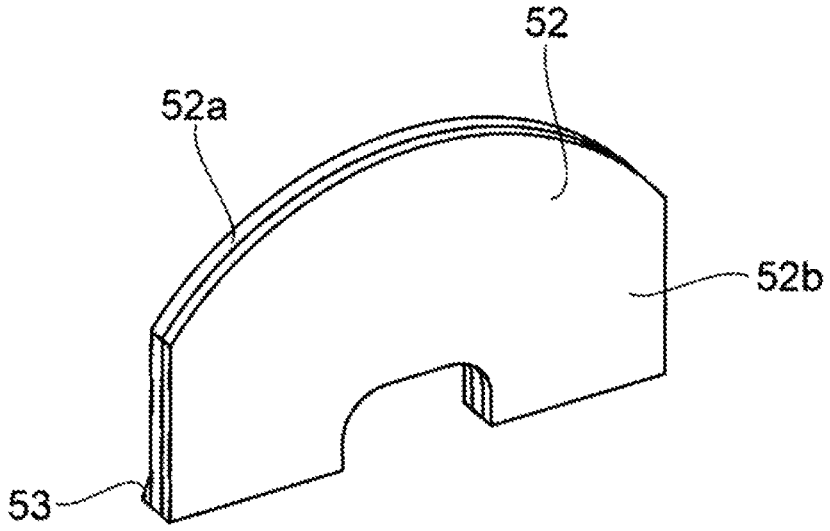
FIG. 8 is an enlarged perspective view showing the structure of the scraper of the developing device according to the embodiment of the present disclosure.

Further, as shown in FIGS. 4 to 6, the first helical member 43 has a scraper 52 disposed at a portion opposing the toner concentration detection sensor 51. As shown in FIGS. 7 and 8, the scraper 52 is formed by bonding the nonwoven fabric (second member) 52*a* and a polyethylene sheet (first member) 52*b* which have the same shape, by using an adhesive layer (not shown). Thereby, a coefficient of friction between a detection surface 51*a* and the member (nonwoven fabric 52*a*) of the scraper 52 on the opposite side from the polyethylene sheet 52*b* can be easily made higher than a coefficient of friction between the detection surface 51*a* and the polyethylene sheet 52*b*.

The nonwoven fabric 52*a* has a thickness of about 1 mm, and the polyethylene sheet 52*b* has a thickness of about 0.1 mm to about 0.2 mm. The coefficient of friction between the nonwoven fabric 52*a* and the detection surface 51*a* of the toner concentration detection sensor 51 is higher than the coefficient of friction between the polyethylene sheet 52*b* and the detection surface 51*a* of the toner concentration detection sensor 51. In addition, the polyethylene sheet 52*b* is formed of so-called ultra-high molecular weight polyethylene having a molecular weight of about 1 million to about 7 million, and therefore, has a wear resistance higher than that of the nonwoven fabric 52*a*. Thus, the wear resistance of the polyethylene sheet 52*b* can be easily made higher than the wear resistance of the nonwoven fabric 52*a*.

An adhesive layer 53 such as a double-sided adhesive tape is bonded to the inner circumferential side of the nonwoven fabric 52*a* (a portion of the nonwoven fabric 52*a* on the rotation shaft 43*b* side when the nonwoven fabric 52*a* is bonded to the first helical member 43). Then, as shown in FIG. 6, the scraper 52 is bonded, by using the adhesive layer 53, to a surface of the first helical blade 43*a*, which surface faces the downstream side in the rotation direction when the first helical member 43 rotates forward. Thereby, when the first helical member 43 rotates forward, the detection surface 51*a* of the toner concentration detection sensor 51 can be easily cleaned by the polyethylene sheet 52*b*. At this time, the scraper 52 is bonded to the first helical blade 43*a* such that the projection height of the scraper 52 from a tip (an outer circumferential surface, a lower surface in FIG. 6) of the first helical blade 43*a* is larger than the distance between the tip of the first helical blade 43*a* and the detection surface 51*a* of the toner concentration detection sensor 51. Therefore, the scraper 52, with its tip portion being bent, comes into contact with the detection surface 51*a* of the toner concentration detection sensor 51.

It is noted that, if the rotation shaft 43*b* is formed of resin only as in the present embodiment, the above-mentioned projection height of the scraper 52 is set to be larger so that the scraper 52 reliably slides on (comes into contact with) the detection surface 51*a* of the toner concentration detection sensor 51 even when the rotation shaft 43*b* is bent.

Figure 9:
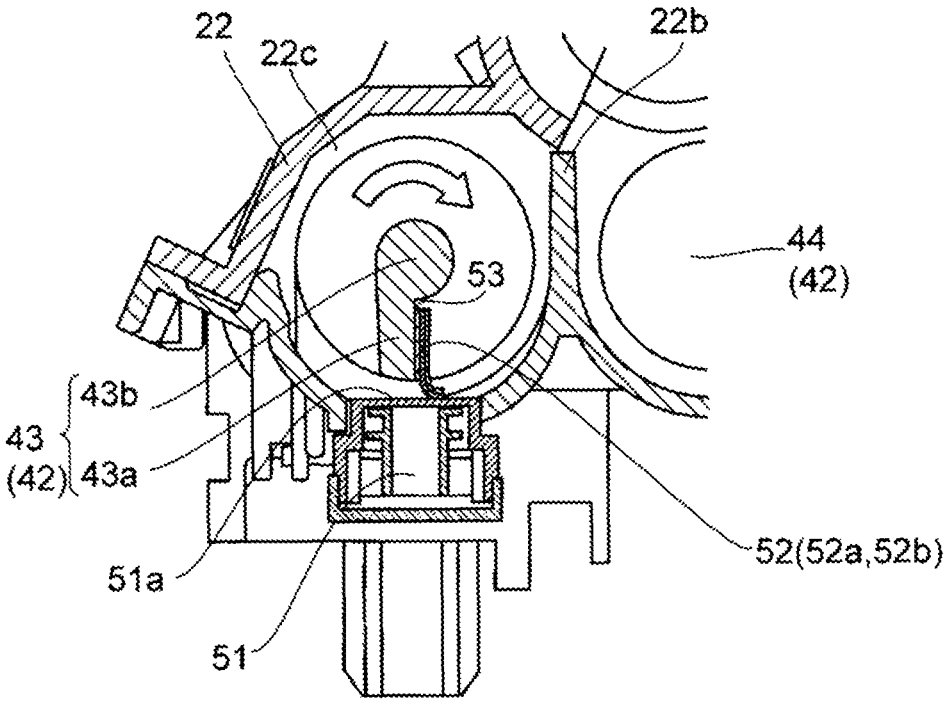
FIG. 9 is a sectional side view showing the structure in the vicinity of the first helical member of the developing device according to the embodiment of the present disclosure.

When the first helical member 43 rotates forward, the surface of the polyethylene sheet 52*b* (one surface of the scraper 52) slides on the detection surface 51*a* of the toner concentration detection sensor 51. On the other hand, when the first helical member 43 rotates reversely, as shown in FIG. 9, the surface of the nonwoven fabric 52*a* (the other surface of the scraper 52) slides on the detection surface 51*a* of the toner concentration detection sensor 51. In this way, the detection surface 51*a* of the toner concentration detection sensor 51 is rubbed and cleaned by either the polyethylene sheet 52*b* or the nonwoven fabric 52*a*.

As for timing to cause the first helical member 43 to rotate reversely, the timing may be when each printing operation is ended or when the number of printed sheets reaches a predetermined number. Further, when the first helical member 43 is caused to rotate reversely, the second helical member 44 may also be caused to rotate reversely.

Conventionally, when nonwoven fabric is used as a scraper, the nonwoven fabric is worn out due to its sliding on a detection surface of a toner concentration detection sensor over a long period of time. Therefore, it is difficult to prevent accumulation of a developer on the detection surface of the toner concentration detection sensor over a long period of time. In the present embodiment, however, as described above, the scraper 52 includes the polyethylene sheet 52*b* that comes into contact with the detection surface 51*a* of the toner concentration detection sensor 51 when the first helical member 43 rotates forward, and the nonwoven fabric 52*a* that comes into contact with the detection surface 51*a* of the toner concentration detection sensor 51 when the first helical member 43 rotates reversely. The polyethylene sheet 52*b* has a wear resistance higher than that of the nonwoven fabric 52*a*. Thereby, during forward rotation of the first helical member 43, the scraper 52 is suppressed from being worn out due to its sliding on the detection surface 51*a* of the toner concentration detection sensor 51, and therefore, accumulation of the developer on the detection surface 51*a* of the toner concentration detection sensor 51 can be prevented over a long period of time. Therefore, the toner concentration can be accurately detected by the toner concentration detection sensor 51 over a long period of time.

Further, the coefficient of friction between the nonwoven fabric 52*a* and the detection surface 51*a* is higher than the coefficient of friction between the polyethylene sheet 52*b* and the detection surface 51*a*. That is, the nonwoven fabric 52*a* has a higher cleaning power against the detection surface 51*a* of the toner concentration detection sensor 51 than the polyethylene sheet 52*b*. Therefore, by rotating the first helical member 43 reversely, the detection surface 51*a* of the toner concentration detection sensor 51 can be cleaned more effectively by the nonwoven fabric 52*a*. Accordingly, it is possible to remove, by the nonwoven fabric 52*a*, a thin layer of the developer that has been gradually accumulated on the detection surface 51*a* of the toner concentration detection sensor 51 and cannot be completely removed by the polyethylene sheet 52*b*. Therefore, the toner concentration can be accurately detected by the toner concentration detection sensor 51 over a long period of time.

Further, the first helical member 43 rotates forward during image formation to agitate and convey the developer in the developer container 22, and rotates reversely when image formation is not performed. Therefore, when image formation is not performed, the detection surface 51*a* can be cleaned by the nonwoven fabric 52*a* having the high cleaning power.

When the rotation shaft 43*b* is formed of resin, the rotation shaft 43*b* is likely to be bent due to a counterforce when agitating and conveying the developer. Therefore, when the scraper 52 is bonded to the first helical blade 43*a*, the projection height thereof from the tip of the first helical blade 43*a* is set to be larger so that the scraper 52 can reliably slide on the detection surface 51*a* of the toner concentration detection sensor 51 even when the rotation shaft 43*b* is bent, which makes the scraper 52 more likely to be worn out. Accordingly, suppressing wear of the scraper 52 is more particularly effective when the rotation shaft 43*b* is formed of resin.

It is to be understood that the embodiments herein are illustrative and not restrictive, since the scope of this disclosure is defined by the appended claims rather than by the description preceding them, and all changes that fall within metes and bounds of the claims, or equivalence of such metes and bounds thereof are therefore intended to be embraced by the claims.

For example, in the above embodiment, the present disclosure is not limited to the tandem-type color printer, and is applicable to various image forming apparatuses provided with a developing device including a toner detection sensor and a scraper, such as a digital or analog monochrome copy machine, a color copy machine, a facsimile, and the like.

In the above embodiment, the two-component developer composed of carrier and toner is used. However, the present disclosure is not limited thereto. A single-component developer composed of toner only may be used. In this case, a remaining-amount-of-toner detection sensor that detects a remaining amount of toner in the developer container may be used as a toner detection sensor.

In the above embodiment, the magnetic permeability sensor is used as a toner detection sensor. However, the present disclosure is not limited thereto. A toner detection sensor other than the magnetic permeability sensor, such as a piezoelectric sensor, may be used.

In the above embodiment, the first member is formed of ultra-high molecular weight polyethylene. However, the present disclosure is not limited thereto. The first member may be formed of polyethylene other than ultra-high molecular weight polyethylene. Alternatively, the first member may be formed of a material (e.g., resin) other than polyethylene.

In the above embodiment, the second member is formed of nonwoven fabric. However, the present disclosure is not limited thereto. The second member may be formed of a material other than nonwoven fabric.

In the above embodiment, the toner detection sensor is disposed in the first conveyance chamber, and the scraper is bonded to the first helical member. However, the toner detection sensor may be disposed in the second conveyance chamber, and the scraper may be bonded to the second helical member.

It is to be understood that the embodiments herein are illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention claimed is:

1. A developing device, comprising:

a developer container configured to contain a developer including toner;

an agitation conveyance member configured to agitate and convey the developer in the developer container;

a toner detection sensor configured to detect a toner concentration or a remaining amount of toner in the developer container; and a scraper, provided on the agitation conveyance member, configured to clean a detection surface of the toner detection sensor when the agitation conveyance member rotates, wherein the agitation conveyance member is configured to be rotatable forward during image formation to agitate and convey the developer in the developer container, and rotatable reversely when image formation is not performed, the scraper includes a first member that comes into contact with the detection surface of the toner detection sensor when the agitation conveyance member rotates forward, and a second member that comes into contact with the detection surface of the toner detection sensor when the agitation conveyance member rotates reversely, the first member has a wear resistance higher than that of the second member, and a coefficient of friction between the second member and the detection surface is higher than a coefficient of friction between the first member and the detection surface.

2. The developing device according to claim 1, wherein the first member is formed of polyethylene, and the second member is formed of nonwoven fabric.

3. The developing device according to claim 1, wherein the agitation conveyance member is formed of resin, and includes a rotation shaft and a blade integrally molded with the rotation shaft.

4. The developing device according to claim 1, wherein the agitation conveyance member includes a rotation shaft, and a blade provided around the rotation shaft, and the second member of the scraper is attached to a surface of the blade, the surface facing a downstream side in a rotation direction when the agitation conveyance member rotates forward.

5. An image forming apparatus including a developing device, the developing device comprising:

a developer container configured to contain a developer including toner;

an agitation conveyance member configured to agitate and convey the developer in the developer container;

a toner detection sensor configured to detect a toner concentration or a remaining amount of toner in the developer container; and a scraper, provided on the agitation conveyance member, configured to clean a detection surface of the toner detection sensor when the agitation conveyance member rotates, wherein the agitation conveyance member is configured to be rotatable forward during image formation to agitate and convey developer in the developer container, and rotatable reversely when image formation is not performed, the scraper includes a first member that comes into contact with the detection surface of the toner detection sensor when the agitation conveyance member rotates forward, and a second member that comes into contact with the detection surface of the toner detection sensor when the agitation conveyance member rotates reversely, the first member has a wear resistance higher than that of the second member, and a coefficient of friction between the second member and the detection surface is higher than a coefficient of friction between the first member and the detection surface.

6. The image forming apparatus according to claim 5, wherein the first member is formed of polyethylene, and the second member is formed of nonwoven fabric.

7. The image forming apparatus according to claim 5, wherein the agitation conveyance member is formed of resin, and includes a rotation shaft and a blade integrally molded with the rotation shaft.

8. The image forming apparatus according to claim 5, wherein the agitation conveyance member includes a rotation shaft, and a blade provided around the rotation shaft, and the second member of the scraper is attached to a surface of the blade, the surface facing a downstream side in a rotation direction when the agitation conveyance member rotates forward.

* * * * *